US005947448A

United States Patent [19]

Lewis et al.

[11] Patent Number: 5,947,448

[45] Date of Patent: Sep. 7, 1999

[54] PORTABLE VEHICLE LIFT AND METHOD

[75] Inventors: Dave Lewis, Broken Arrow; Danny L. Johnson, Tulsa, both of Okla.

[73] Assignee: Kwiklift, Inc., Broken Arrow, Okla.

[21] Appl. No.: 09/062,862

[22] Filed: Apr. 20, 1998

[51] Int. Cl.[6] ..... E02C 3/00

[52] U.S. Cl. ..... 254/88; 254/90

[58] Field of Search ..... 254/88, 90, 91; 187/216

[56] References Cited

U.S. PATENT DOCUMENTS

| | | | |
|---|---|---|---|
| Re. 26,232 | 6/1967 | Lill . | |
| 777,219 | 12/1904 | Owen . | |
| 1,265,688 | 5/1918 | Lively . | |
| 1,334,431 | 3/1920 | Ball | 254/88 |
| 1,448,261 | 3/1923 | Custer | 254/91 |
| 1,477,332 | 12/1923 | Elzey . | |
| 1,480,529 | 1/1924 | Baker . | |
| 1,527,901 | 2/1925 | Munday . | |
| 3,804,206 | 4/1974 | Bubik . | |
| 3,888,100 | 6/1975 | Chisum . | |
| 4,134,501 | 1/1979 | Tune . | |
| 4,238,003 | 12/1980 | Hunter . | |
| 4,486,006 | 12/1984 | Fawdry . | |
| 4,886,243 | 12/1989 | Trumbell . | |
| 5,141,371 | 8/1992 | Pish . | |
| 5,215,287 | 6/1993 | Leski . | |
| 5,641,150 | 6/1997 | Rober . | |

*Primary Examiner*—Robert C. Watson
*Attorney, Agent, or Firm*—Head, Johnson and Kachigian

[57] ABSTRACT

A portable vehicle lifting apparatus and method comprising a pair of ramps, with each ramp pivotly connected to a base unit and having a lifting bar pivotly connected between each ramp. Once a vehicle is loaded onto the ramps, the ramps are raised by way of the lifting bar.

8 Claims, 5 Drawing Sheets

PORTABLE VEHICLE LIFT AND METHOD

BACKGROUND OF THE INVENTION

1. Field of the Invention

The present invention relates generally to a vehicle lifting apparatus. More specifically, with a pair of pivotal ramps on which a vehicle can be placed on. The ramps are initially in an angled position, thus, allowing the vehicle to be driven directly from the ground onto the ramps. The ramps are then lifted by means of a lifting bar into a generally horizontal position. Generally, vehicle lifting apparatus are known in the prior art.

2. Prior Art

Vehicle lifting apparatus are exemplified in the disclosures of Munday, U.S. Pat. No. 1,527,901 of Feb. 1, 1924; Hunter U.S. Pat. No. 4,238,003 of Dec. 9, 1980; Fawdry U.S. Pat. No. 4,486,006 of Dec. 4, 1984 and Rober U.S. Pat. No. 5,641,150 of Jun. 24, 1997. Each of these prior art patents embody a vehicle lift apparatus in which a pair of pivotal ramps move between a generally horizontal position and an angled position. The pivoting mechanism is either a fulcrum type mechanism located approximately at the center of each ramp or a pivotal mechanism connected to a base at one end of each ramp. The lifting mechanisms of each apparatus have taken on different forms including pistons, pressurized fluids lifting devices and cylinder lifting devices.

The prior art discloses a number of problems and difficulties, the first of which is the complicated nature of the devices. Due to the intricate nature of these devices, great care is needed when during the installation and use of these devices. Another problem in the art is the lack of portability of the apparatus. The prior art patents disclose apparatus which are required to be secured to a floor or include bulky or heavy machinery.

The present invention is directed toward an improved vehicle lift apparatus and method which address the problems in the prior art.

SUMMARY OF THE INVENTION

The present invention is directed toward an improved vehicle lift apparatus and method which includes a pair of ramps, each ramp having one end pivotally connected to a base. Each ramp is able to be moveable between a generally horizontal position and an angled position. When in the angled position, a second end of each ramp is in contact with the ground. While in this position, the vehicle can be loaded onto or off of each ramp. The ramps are moved in unison into the desired position by the use of a lifting bar. Support legs pivot from each ramp in which to secure the ramp in a generally horizontal position.

The lifting bar, which has an intermediate offset portion, is pivotally connected to both ramps in a generally perpendicular manner and is movable between a generally horizontal position and a generally vertical position. When the lifting bar is in a generally vertical position, the offset portion creates a recess between the bar and the ground. A lifting means such as a floor jack can be placed within the recess and when activated lift the ramps via the lifting bar to a desired height. When the lifting bar is in a generally horizontal position, the offset portion is in contact with the ground, allowing vehicles to be loaded onto or off of the ramps without contact to the bar.

The lifting bar provides additional benefits over the prior art. The lifting bar provided latitudinal support to the pair of ramps. By being connected to both ramps, the lifting bar prevents the ramps from moving independantly of each other in a latitudinal manner. Further, the distance between the pair of ramps can be adjusted to accommodate the wheelbase of any vehicle. This is accomplished by adjusting the length of the lifting bar or by having multiple connections on the lifting bar.

Additionally, the apparatus improves over the prior art in that it can be easily disassembled, allowing for easy transportability and storage. The appartaus can be broken down into three main parts, the base, the ramps, and the lifting bar. Further, the ramps can be separated into multiple parts, for example a front piece and a back piece.

Further, by having the lifting bar located near the rear portion of the ramps, there is no lifting machinary located directly underneath the vehicle. This will allow a person, such as a mechanic, to have complete access to the undercarriage of the vehicle. This is an advantage over prior art lifting devices.

The primary objective of the present invention is to provide an apparatus embodying simple effective means for lifting a vehicle.

Another objective of the present invention is to provide an apparatus which does not require the use of complicated machinery.

Another objective of the present invention is to provide an apparatus which can be easily portable and storable.

DETAILED DESCRIPTION OF THE PREFERRED EMBODIMENTS

Referring now to the figures, a vehicle lifting apparatus 10 according to the present invention is shown. Vehicle lifting apparatus 10 generally comprises a pair of ramps 14, a pair of base units 20 and a lifting bar 32 pivotally connected to said ramps 14.

Figure 1:
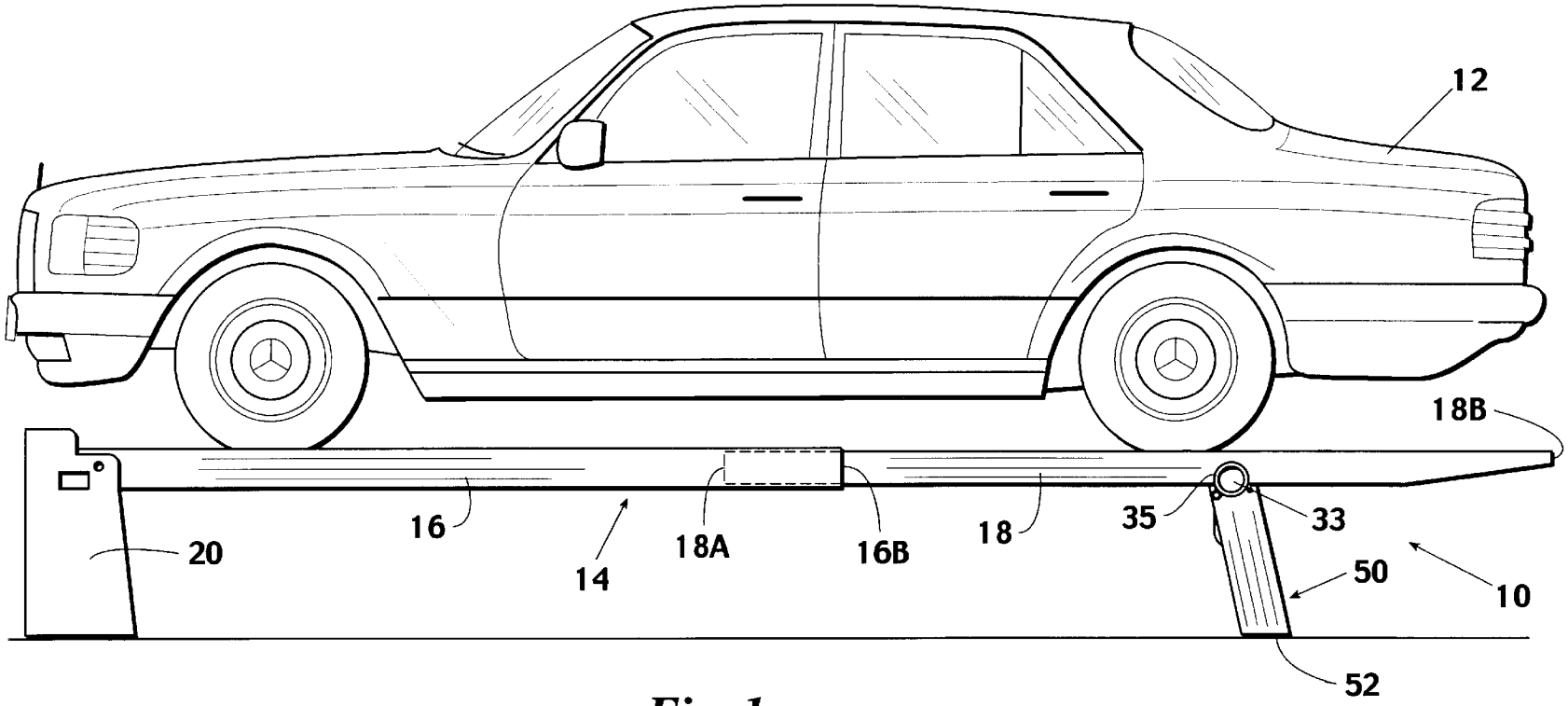
FIG. 1 is a perspective view of the present invention in the generally horizontal position.
Figures 2, 3, 4:
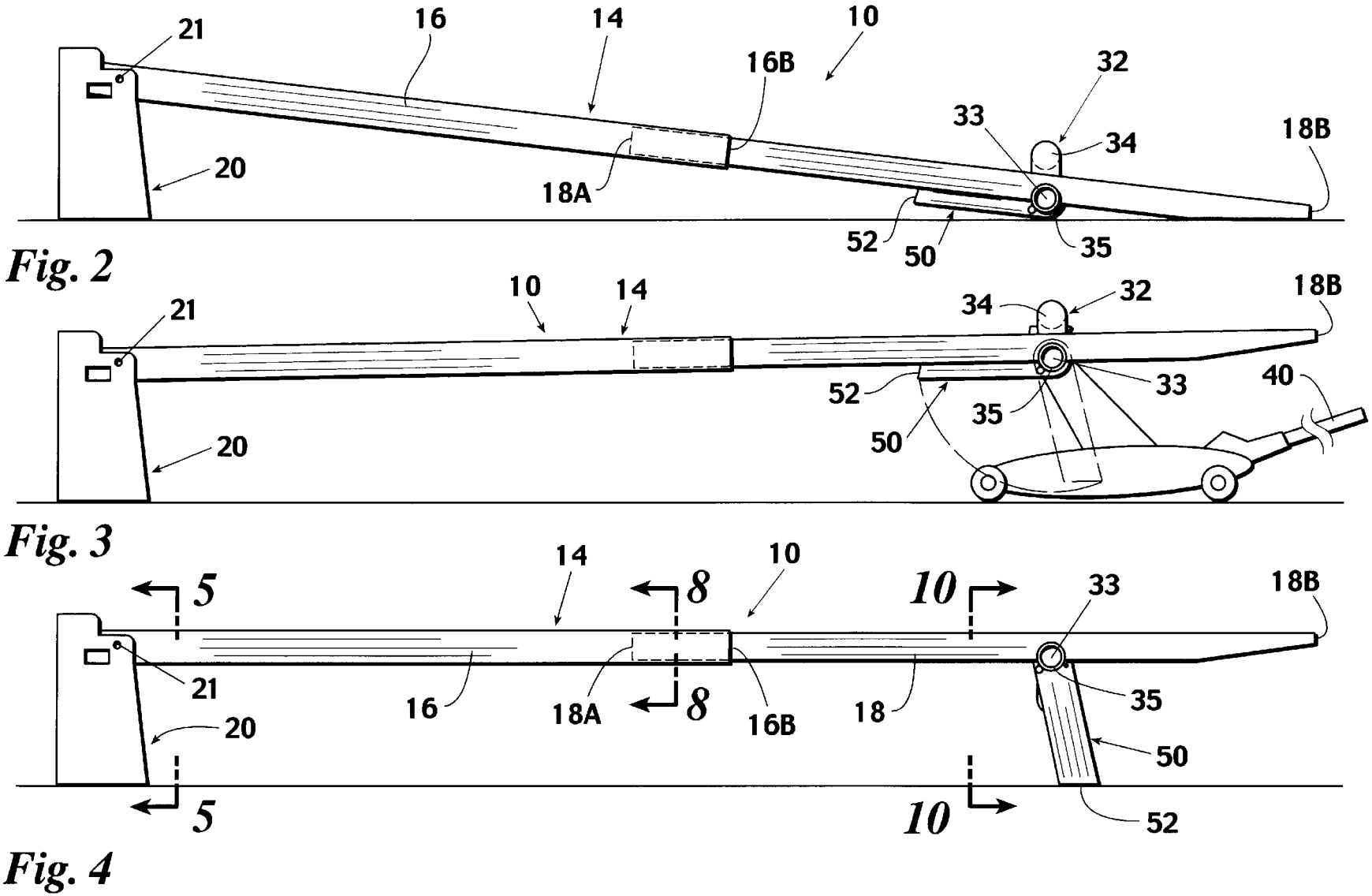
FIG. 2 is a perspective view of the present invention in a generally angled position.
FIG. 3 is a view similar to FIG. 2 showing the present invention being lifted by the means of a lifting device.
FIG. 4 is a view similar to FIG. 2 showing the present invention in a generally horizontal position.

As shown in FIGS. 2–4, ramp 14 is pivotally mounted to base 20 and is able to move between an angled position as shown in FIG. 2 to a generally horizontal position as shown in FIG. 4. Ramp 14 is able to be raised or lowered into the desired position by means of a floor jack 40 being engaged with lifting bar 32.

Figure 8:
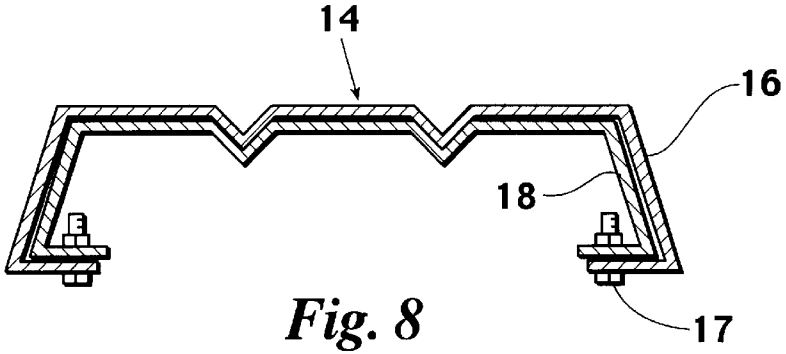
FIG. 8 is a cross-sectional view of the ramp portion of the present invention.
Figure 12:
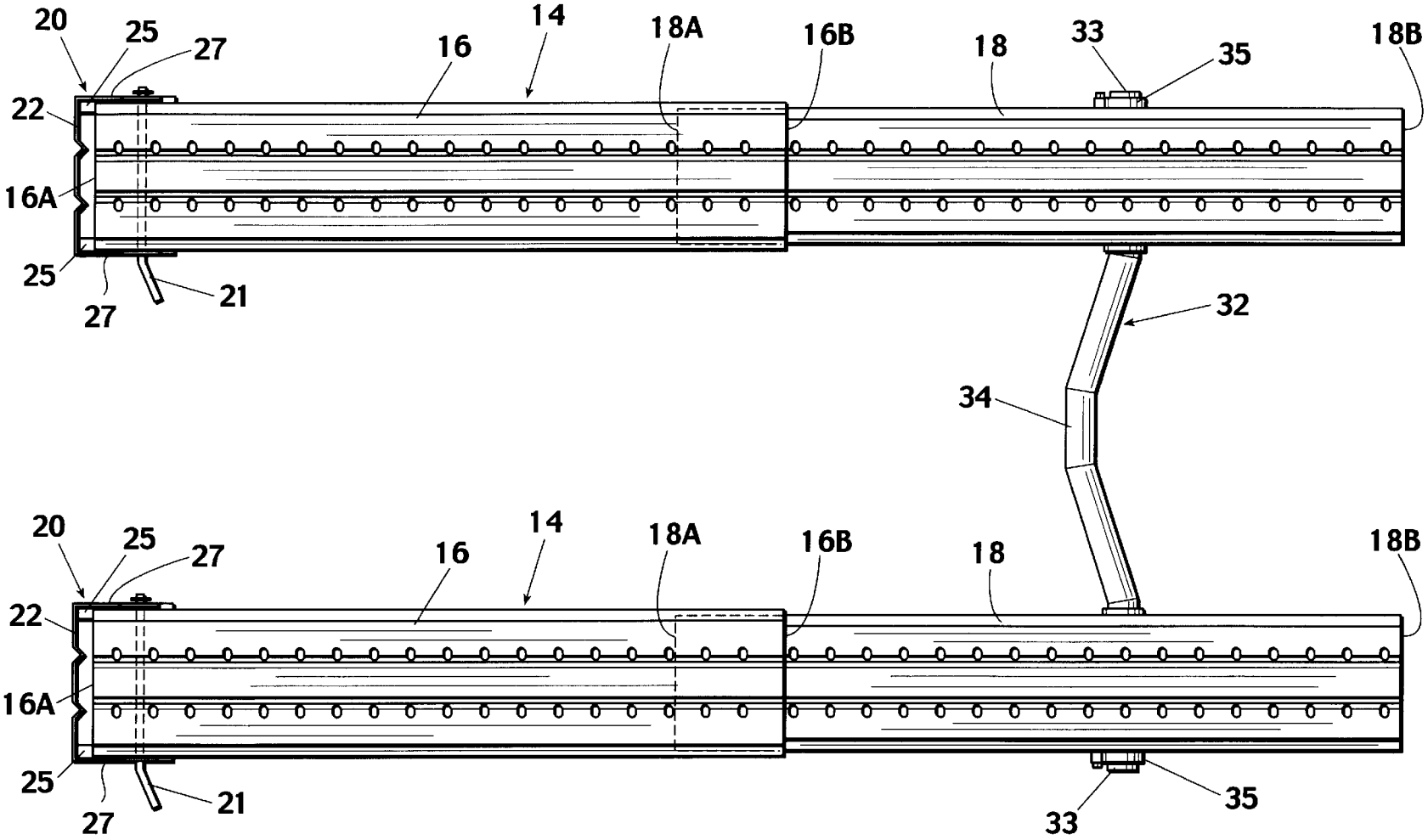
FIG. 12 is a top plane view.

As shown in FIGS. 8 and 12, ramp 14 comprises a first section 16 and a second section 18, each section having a front end 16A and 18A, and a the rear end 16B and 18B, respectively. Front end 16B of first section 16 is rigidly connected to the front end 18A of section 18 by means of bolts 17.

Figure 7:
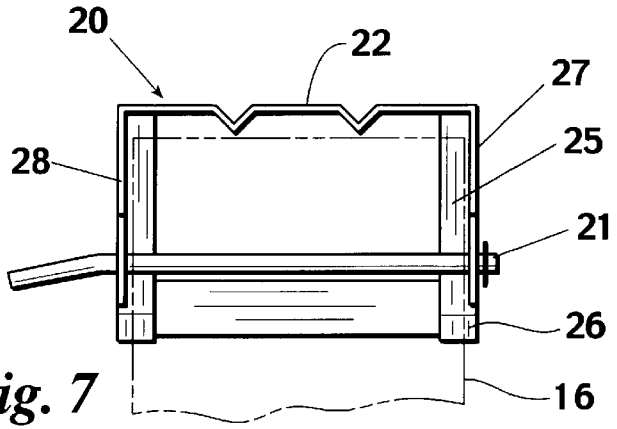
FIG. 7 is a cross-sectional top view of FIG. 5.
Figure 5:
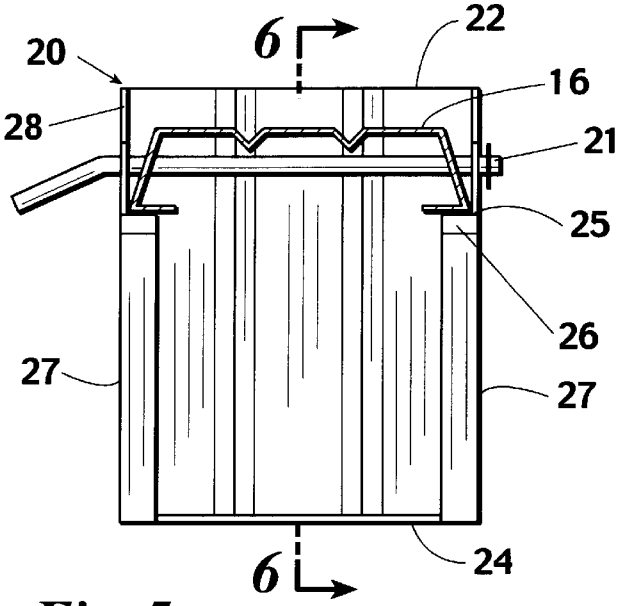
FIG. 5 is a cross-sectional view of FIG. 4 along line 5—5.
Figure 6:
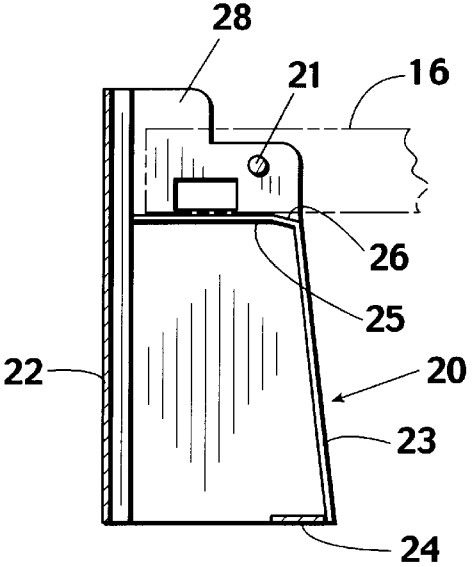
FIG. 6 is a cross-sectional view of FIG. 5 along line 6—6.

Base unit 20 is generally shown in FIGS. 5–7. Base unit 20 comprises a front panel 22, a back panel 23, a bottom panel 24, two side panels 27, retaining wall 28, support ledge 25, having as an angled ledge section 26 proximate to back panel 23. Ramp 14 rests upon support ledge 25 and is secured to base 20 by means of pin 21. Angled ledge 26 allows ramp 14 to pivot into an angled position while remaining secured to said base unit 20.

Figure 11:
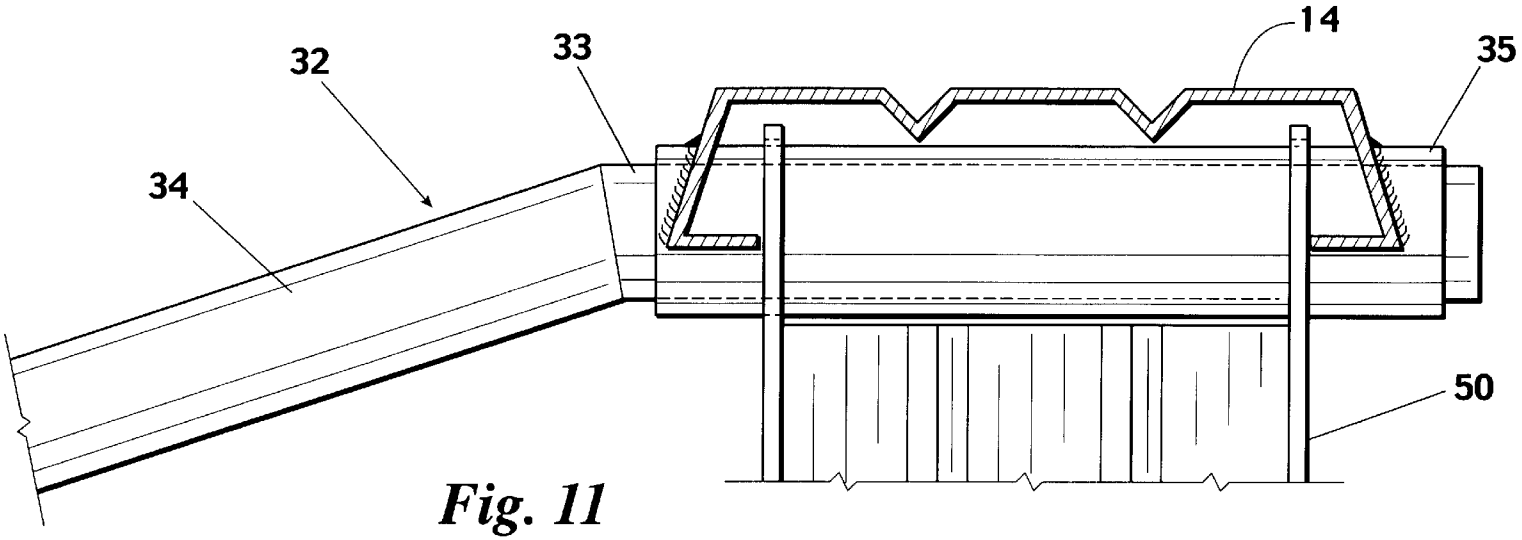
FIG. 11 is a detailed view of the rear housing assembly.
Figure 10:
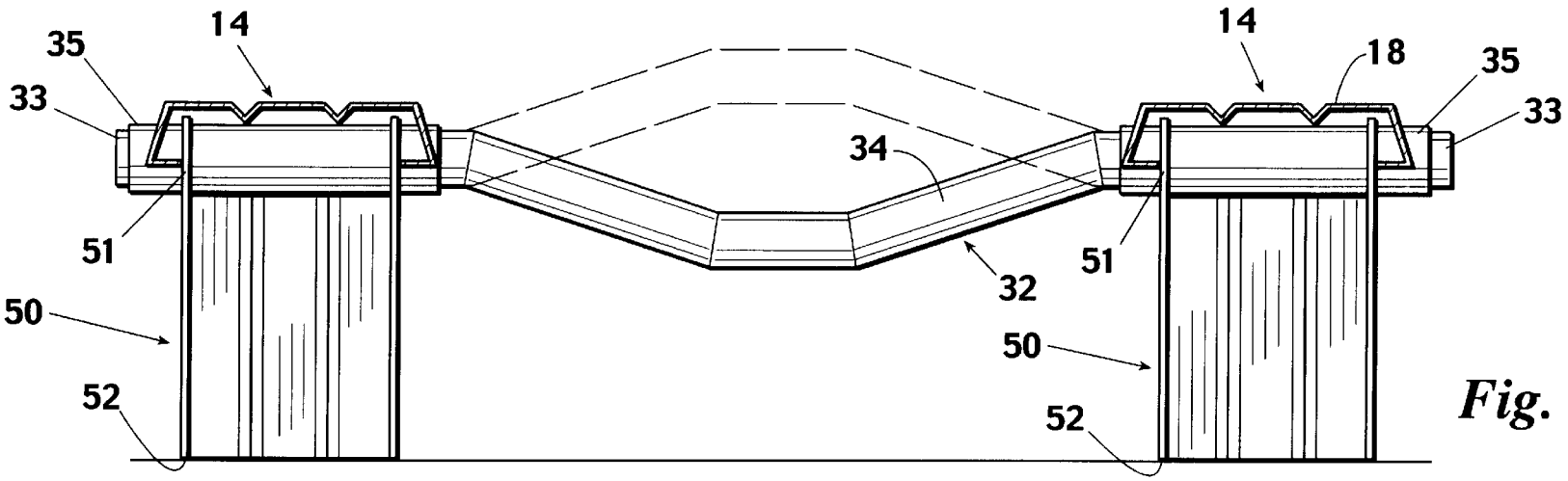
FIG. 10 is a perspective rear view of the present invention.

Support lifting bar 32 comprises ends 33, generally located on a central axis, and an intermediate middle portion 34, which is generally offset from central axis as shown in FIG. 10. As shown in FIG. 11, end portion 33 is pivotally received within tube 35. This allows lift bar 32 to be pivotally moveable as to allow intermediate middle portion 34 to be in contact with the ground as well as be in a generally upright position as shown in FIG. 10.

Figure 9:
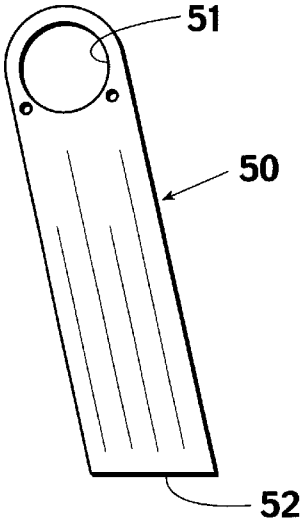
FIG. 9 is a view of the pivoting rear leg.

As shown in FIGS. 9–11, support leg 50 comprises pivot end 51 and a securing end 52. Pivot end 51 is pivotally mounted to tube 35 and is secured by securing means 38. Support leg 50 is in a generally retracted state located within ramp 14 when ramp 14 is in a generally angled position. When ramp 14 is raised to a generally horizontal position, support leg 50 pivots into a generally vertical position with support end 52 being in contact with the ground.

Whereas, the present invention has been described in relation to the drawings attached hereto, it should be understood that other and further modifications, apart from those shown or suggested herein, may be made within the spirit and scope of this invention.

What is claimed is:

1. A portable vehicle lift comprising:

a lift bar, having a first end, a second end and an intermediate portion, with said first end and second end aligned generally along a center axis and said intermediate portion generally offset from said center axis a pair of base units, with each said base unit in contact with the ground, a pair of ramps in parallel, wherein each ramp comprises a front end, a rear end, and means to pivotly receive said lift bar, wherein each front end is pivotly attached to a base unit allowing each ramp to be movable between a generally horizontal position and an angled position, wherein each said rear end is in contact with the ground while each said ramp is in an angled position, and a support leg pivotly attached to each said ramp.

2. The portable vehicle lift of claim 1 wherein each support leg further comprises:

a pivot end mounted to said rear end of each ramp, and a ground engaging end, whereby when said ramp is in a generally horizontal position, said ground engaging end engages the ground.

3. The portable vehicle lift of claim 1 wherein each ramp further comprises a plurality of detachable sections and is dismantlable for portability and storage.

4. The portable vehicle lift of claim 1 wherein said lift bar extends between each said ramps intermediate length thereof.

5. The portable vehicle lift of claim 1 wherein said means to pivotly receive said lift bar is located proximate to said rear end.

6. A portable vehicle lift comprising:

a lift bar having a first end, a second end and an intermediate portion, with said first end and second end aligned generally along a center axis, with said intermediate portion generally offset from said center axis, a pair of base units, with each said base unit in contact with the ground, a pair of ramps in parallel, wherein each ramp comprises a front end, a rear end, and means to pivotly receive said lift bar, wherein each front end is pivotly attached to a base unit allowing each ramp to be movable between a generally horizontal position and an angled position, with each said rear end in contact with the ground while each said ramp is in the angled position, with said means to pivotly receive said lift bar located proximate to said rear end, and a support leg pivotly attached to each ramp, wherein each support leg further comprises: a third end pivotly mounted to said rear end of each ramp, and a fourth end, whereby when said ramp is in a generally horizontal position, said fourth end engages the ground.

7. The portable vehicle lift of claim 6 wherein each ramp further comprises a plurality of detachable sections and is dismantlable for portability and storage.

8. The portable vehicle lift of claim 6 wherein said lift bar extends between each said ramps intermediate length thereof.

* * * * *